US008485105B2

(12) United States Patent
Heyden et al.

(10) Patent No.: US 8,485,105 B2
(45) Date of Patent: Jul. 16, 2013

(54) DEVICES AND SYSTEMS FOR STOPPING TRAVEL OF A RAILCAR

(75) Inventors: Thomas J. Heyden, Arlington Heights, IL (US); Gregory P. Reitz, Silver Lake, WI (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 284 days.

(21) Appl. No.: 12/748,089

(22) Filed: Mar. 26, 2010

(65) Prior Publication Data

US 2011/0232521 A1 Sep. 29, 2011

(51) Int. Cl.
*B61K 7/00* (2006.01)

(52) U.S. Cl.
USPC ..... 104/249; 104/258

(58) Field of Classification Search
USPC ..... 104/249–260
See application file for complete search history.

(56) References Cited

U.S. PATENT DOCUMENTS

| | | | | | |
|---|---|---|---|---|---|
| 2,175,286 | A | * | 10/1939 | Finch | 104/257 |
| 2,807,220 | A | | 9/1957 | McDowell | |
| 2,945,454 | A | * | 7/1960 | Beck | 104/259 |
| 3,128,721 | A | | 4/1964 | McGowan | |
| 3,215,091 | A | * | 11/1965 | Hayes | 104/259 |
| 3,807,532 | A | | 4/1974 | Molt | |
| 3,828,688 | A | * | 8/1974 | Bradbury | 104/252 |
| 3,924,539 | A | | 12/1975 | Wladis | |
| 3,944,174 | A | | 3/1976 | Flinn | |
| 4,080,904 | A | * | 3/1978 | Lofink et al. | 104/162 |
| 4,216,724 | A | * | 8/1980 | Grillet | 104/258 |
| 4,325,307 | A | | 4/1982 | Bick | |
| 4,480,723 | A | | 11/1984 | Ingvast et al. | |
| 4,498,561 | A | | 2/1985 | Sanders | |
| 4,739,863 | A | * | 4/1988 | Stauffer | 188/32 |
| 5,211,115 | A | | 5/1993 | Maier et al. | |
| 5,388,525 | A | | 2/1995 | Bodkin | |
| 5,836,252 | A | | 11/1998 | Roick | |
| 5,947,030 | A | | 9/1999 | Spieldiener et al. | |
| 6,152,042 | A | * | 11/2000 | Barry et al. | 104/26.2 |
| 6,155,178 | A | * | 12/2000 | Pease | 104/258 |
| 6,520,298 | B1 | | 2/2003 | Meuters et al. | |
| 6,773,221 | B2 | * | 8/2004 | Belongia et al. | 414/401 |
| 7,717,043 | B2 | * | 5/2010 | Rastegar et al. | 104/26.2 |
| 8,020,494 | B2 | * | 9/2011 | Smith et al. | 104/250 |
| 8,079,309 | B2 | * | 12/2011 | Heyden et al. | 104/249 |
| 2007/0062407 | A1 | | 3/2007 | Kickbush | |
| 2009/0031914 | A1 | * | 2/2009 | Hahn et al. | 104/249 |
| 2010/0083865 | A1 | * | 4/2010 | Heyden et al. | 104/249 |
| 2011/0120340 | A1 | * | 5/2011 | Smith et al. | 104/249 |
| 2011/0232521 | A1 | * | 9/2011 | Heyden et al. | 104/249 |
| 2011/0265679 | A1 | * | 11/2011 | Smith et al. | 104/53 |
| 2012/0012027 | A1 | * | 1/2012 | Thyssen, Jr. | 104/259 |

* cited by examiner

*Primary Examiner* — Jason C Smith
(74) *Attorney, Agent, or Firm* — Andrus, Sceales, Starke & Sawall, LLP

(57) ABSTRACT

Devices and systems for stopping travel of a railcar along rails is provided, the railcar having wheel treads that ride on the rails. A railcar stop is configured to engage at least one wheel tread of the railcar to stop travel of the railcar along the rails. The railcar stop extends above the rails at a first height prior to engagement with a wheel tread and extends above the rails at a second, greater height after engagement with the wheel tread.

10 Claims, 6 Drawing Sheets

DEVICES AND SYSTEMS FOR STOPPING TRAVEL OF A RAILCAR

FIELD

The present patent application relates to devices and systems for stopping travel of a railcar along a set of rails.

BACKGROUND

The present patent application relates to applicant's co-pending U.S. patent application Ser. No. 12/247,810, which is entirely incorporated herein by reference.

SUMMARY

The present patent application discloses devices and systems for stopping travel of a railcar along a set of rails. In one example, a railcar stop is configured to engage at least one wheel tread of the railcar to stop travel of the railcar along the rails. The railcar stop extends above the rails at a first height prior to engagement with a wheel tread and extends above the rails at a second, greater height after engagement with the wheel tread.

BRIEF DESCRIPTION OF THE DRAWINGS

Reference is made herein to the following drawing figures.

DETAILED DESCRIPTION OF THE DRAWINGS

In the following description, certain terms have been used for brevity, clearness and understanding. No unnecessary limitations are to be implied therefrom beyond the requirement of the prior art because such terms are used for descriptive purposes only and are intended to be broadly construed. The different systems and devices described herein may be used alone or in combination with other systems and devices. It is to be expected that various equivalents, alternatives and modifications are possible within the scope of the appended claims. Each limitation in the appended claims is intended to invoke interpretation under 35 U.S.C. §112, $6^{th}$ paragraph only if the terms "means for" are explicitly included in the respective limitation.

Figure 1:
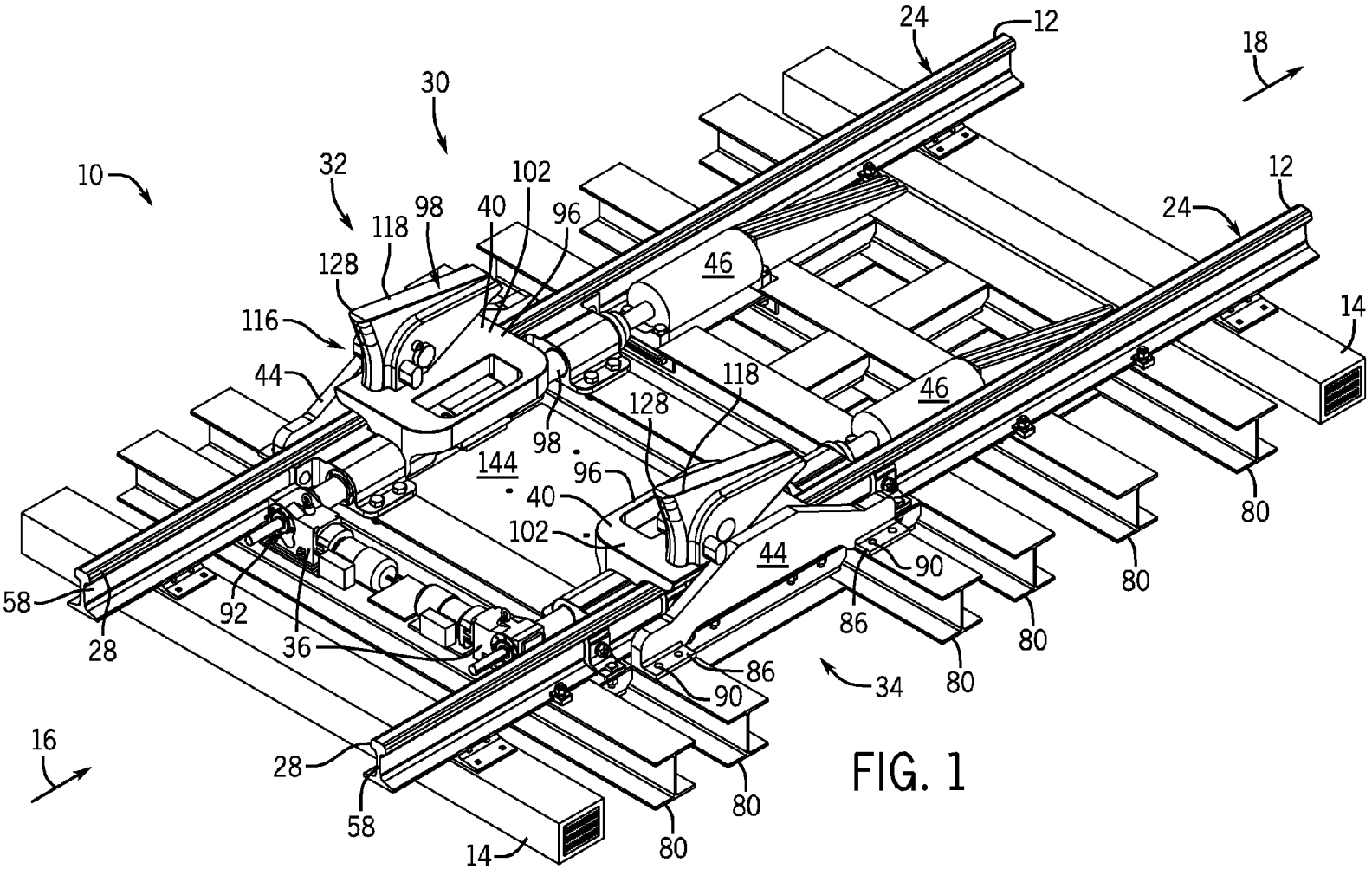
FIG. 1 is a perspective view of a section of railroad tracks and a system for controlling travel of a railcar.

FIG. 1 depicts a section of railroad tracks 10 that includes a pair of conventional rails 12 mounted on railroad ties 14. The rails 12 continue in both directions with railcars entering the section of tracks 10 from an uptrack direction shown by arrow 16 and exiting the section of tracks 10 in a downtrack direction shown by arrow 18. Railcars typically include sets of wheels, an example of one of which is shown schematically in FIG. 3 at 20. Each wheel 20 includes a wheel tread 22 that is configured to ride along the top surface 24 of one of the rails 12. Each wheel 20 also includes a flange 26 that extends transversely outwardly from the tread 22. The flange 26 is configured to engage the inner side surface 28 of the respective rail 12.

FIG. 1 also depicts a system 30 mounted to the tracks 10 for stopping travel of a railcar along the rails 12. The system 30 includes two railcar stops 32, 34. Each railcar stop 32, 34 includes a connecting pin 38, a wing 40 that is connected to and rotates as the connecting pin 38 rotates, a mounting block 42 connecting the connecting pin 38 and wing 40 to the rail 12, and a backing member 44 located outside the rails with respect to the mounting block 42 and wing 40. The system 30 further includes among other things a motor 36 that is configured to cause clockwise and counterclockwise rotation of the connecting pin 38 and wing 40, and a shock absorber 46 that is located in the downtrack direction 18 with respect to the respective railcar stop 32, 34. The two railcar stops 32, 34 and other related structures of the system 30 are substantially mirror images of each other and are positioned adjacent each other on the pair of rails 12. Some of the discussion herein below is directed to only one of the railcar stops 32, 34, but such discussion applies equally to both railcar stops 32, 34.

Figure 2:
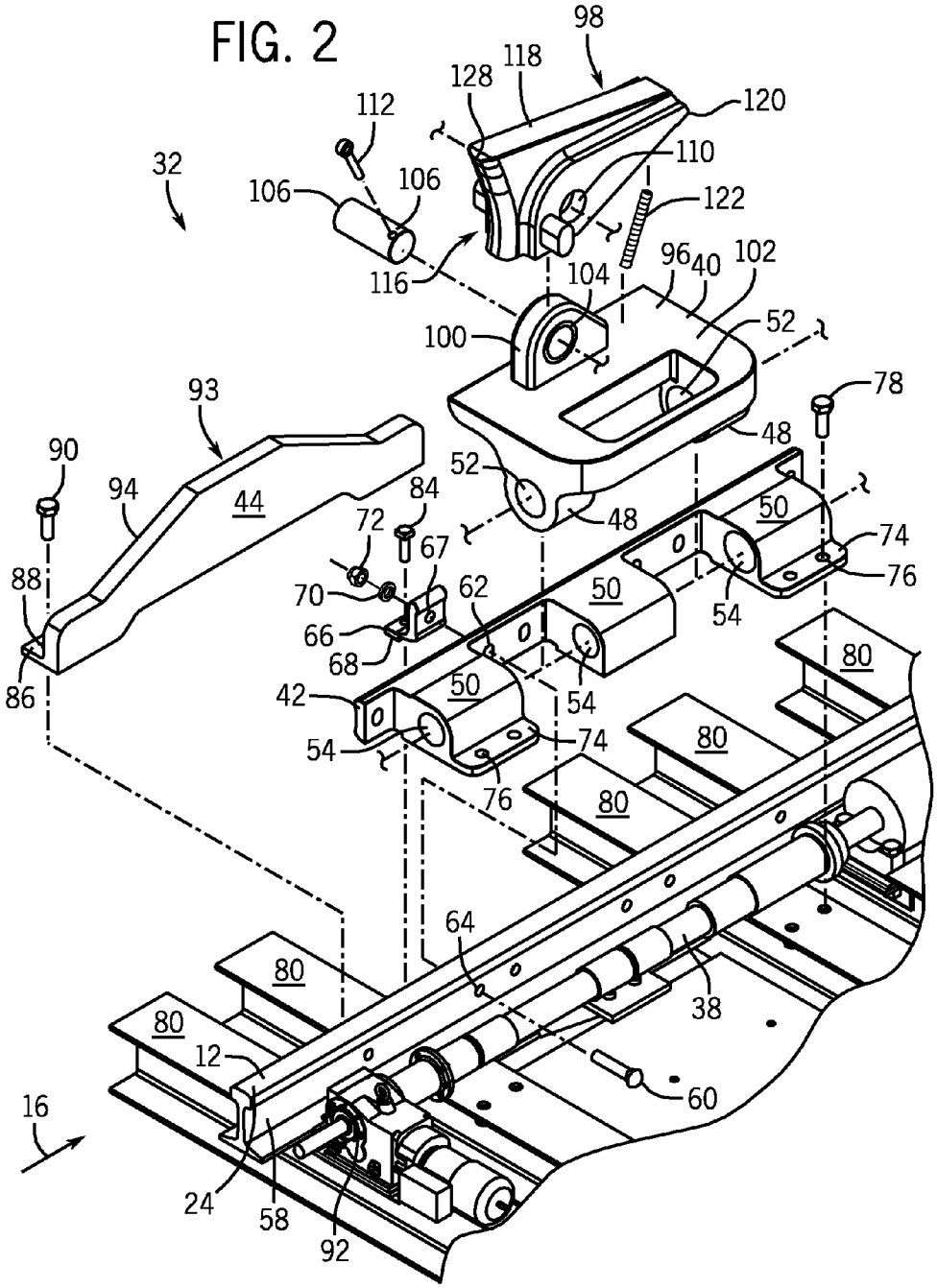
FIG. 2 is a perspective exploded view of a railcar stop associated with the system shown in FIG. 1.

FIG. 2 shows an example of the railcar stop 32 in more detail. The wing 40 is connected to the mounting block 42 by a hinged connection. Specifically, the wing 40 includes a series of aligned downwardly extending knuckles 48, which are sized and shaped to fit between corresponding knuckles 50 on the mounting block 42 in an interdigitated alignment. Each of the knuckles 48, 50 has a through-hole 52, 54 configured such that when the knuckles 48, 50 are aligned and interdigitated, the through-holes 52, 54 define a through-way sized and shaped to receive the connecting pin 38. A series of keys (not shown) are embedded in spaced alignment in the connecting pin 38. This type of mated arrangement is shown in more detail in applicant's corresponding U.S. patent application Ser. No. 12/427,810, incorporated herein by reference. According to this arrangement, the wing 40 and connecting pin 38 are locked together to rotate together in unison about a longitudinal hinge axis "A" defined by the connecting pin 38. Similar structure is provided for railcar stop 34.

As shown in FIG. 2, the mounting block 42 is fixedly connected to an inside surface 58 of rail 12 by a plurality of bolts, an example of which is shown at 60. Bolts 60 are threaded through corresponding aligned apertures, 62, 64, 67 formed in the mounting block 42, rail 12, and an L-shaped bracket 66 located adjacent the outside surface 68 of rail 12. Washers 70 are placed onto the threaded ends of the respective bolts 60, and nuts 72 are threaded onto the threaded ends of the respective bolts 60 to secure the mounting block 42 and L-shaped bracket 66 to the rail 12. The mounting block 42 includes flanges 74 that extend outwardly from knuckles 50. Each flange 74 includes apertures 76 sized to receive bolts 78 that are screwed into one or more I-beams 80 mounted beneath the rails 12. The L-shaped bracket 66 also includes an aperture 68 sized to receive bolts 84 that are screwed into the one or more I-beams 80 mounted beneath the rails 12.

The backing member 44 is also secured to the I-beams 80 on the opposite side of rail 12 with respect to the mounting block 42 and wing 40. Specifically, the backing member 44 includes outwardly extending flanges 86 having apertures 88 sized to receive bolts 90 that are screwed into the one or more I-beams 80. The backing member 44 includes an upper multi-segmented surface 93 having at least an upwardly sloped surface 94 that is elevated above the top surface 24 of the rail 12. The function of the sloped surface 94 will be described further herein below. Other mounting arrangements could be employed to mount the railcar stops 32, 34 to the rails.

Figure 4:
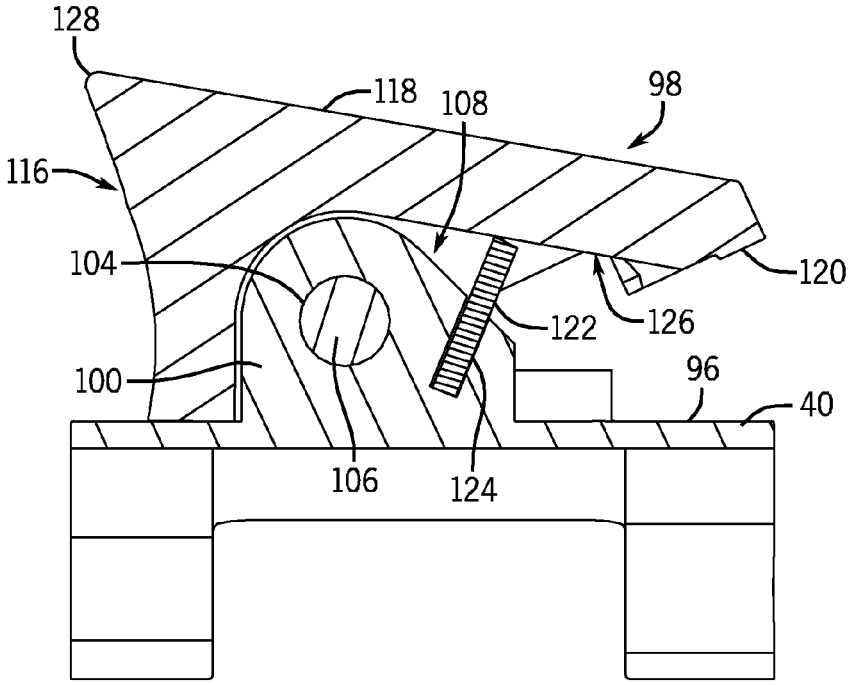
FIG. 4 is a sectional side view of a railcar stop.
Figure 5:
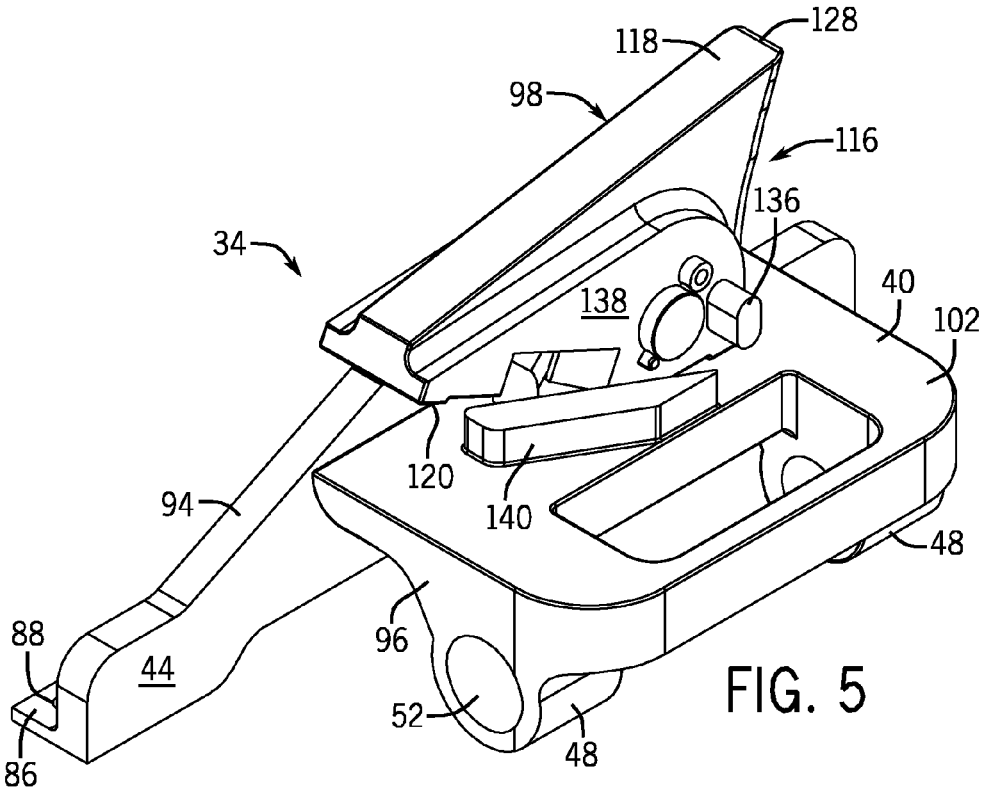
FIG. 5 is a perspective view of a railcar stop.

As shown in FIGS. 2, 4 and 5, each wing 40 includes a base 96 and an upwardly extending fin 98. The upwardly extending fin 98 is attached to the wing 40 by means of a lobe 100 that extends upwardly from the top surface 102 of the base 96 and that defines an axial bearing 104 that is sized and shaped to receive and bear a pivot pin 106. In the example shown, the lobe 100 is inserted into the hollow interior portion of the fin 98 such that the axial bearing 104 is aligned with a through-going aperture 110 in the fin 98. Thereafter, the pivot pin 106 is inserted through the aligned through-going aperture 70 and axial bearing 104 to pivotally couple the fin 98 to the base 96. A bolt 112 is inserted through a hole 114 at the end of the pivot pin 106 and further inserted into a tapped hole (not shown) in the fin 98 to secure connection between the pivot pin 106, base 96 and fin 98. Alternate configurations could be employed to provide the pivoting function described above.

The fin 98 is generally triangular in shape and has a curved bearing surface 116, a top surface 118 and a bottom abutment surface 120. A spring 122 resides in a bore 124 in lobe 100 and biases against inner surface 126 of fin 98 to cause the fin 98 to normally reside in a first position (rotationally about pivot pin 106) shown in FIG. 4. Further explanation of the operation of fin 98 will be provided herein below. Alternate shapes and configurations for fin 98 could be employed to achieve the functions described herein.

As shown in FIG. 1, the motor 36 includes a hollow shafted gearbox that is connected to the connecting pin 38 via a keyed arrangement. Specifically, the gearbox includes a rotatable hollow tube connected to the connecting pin 38 via a keyed arrangement such that rotation of the tube causes rotation of the connecting pin 38. Outer pipe section 92 is provided to cover the connecting pin 38. The pipe section 92 can be filled with oil to provide lubrication and protection during use of the device 30 in for example cold, or otherwise harsh environments. This type of arrangement for motor 36 is described in applicant's co-pending U.S. patent application Ser. No. 12/427,810, incorporated herein by reference. Alternatively, the arrangement described above could include a spline coupling arrangement, such as that described in the above-referenced patent application. Other drive configurations could be employed to drive the system 20.

The shock absorber 46 is mounted to one or more I-beams 80 for stability via a plurality of gussets 94. In the example shown, the shock absorber 46 includes a hydraulic cushion unit or industrial hydraulic shock absorber, or the like. The shock absorber 46 is situated such that when the wing 40 is positioned in a raised, active position shown in FIG. 9, the rear surface 96 of the wing 40 engages an outer tube 98 intermediate the shock absorber 46 and wing 40. This type of arrangement for shock absorber 44 is also described in applicant's co-pending U.S. patent application Ser. No. 12/247,810, incorporated herein by reference. Other shock absorbing devices could be employed to provide the shock absorbing function described above.

Figure 6:
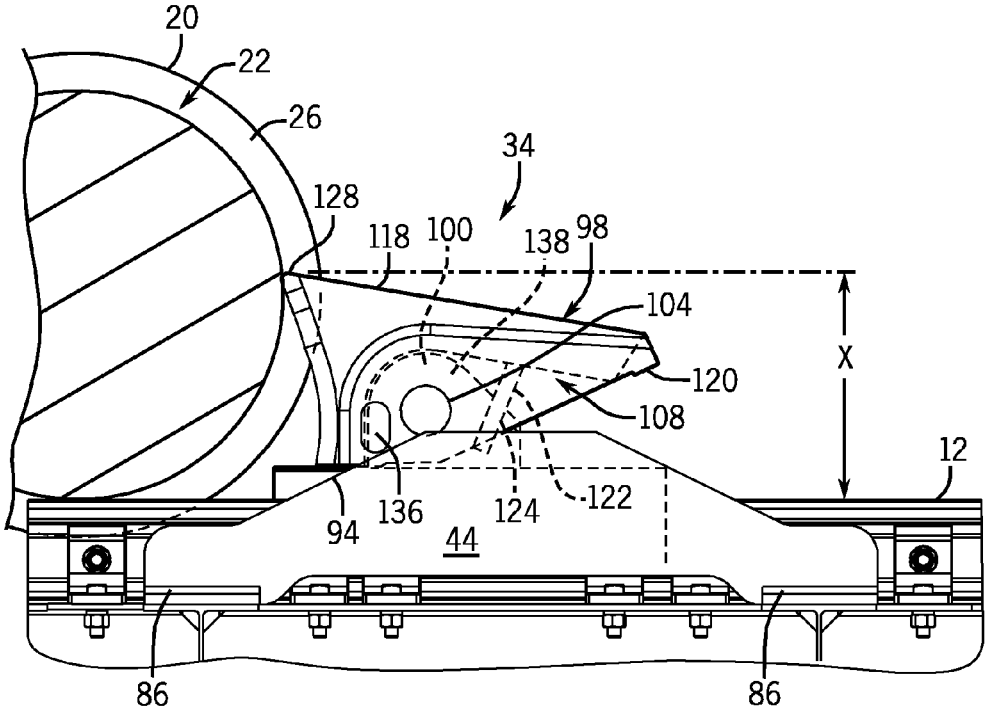
FIG. 6 is a side view of a railcar stop upon initial engagement with a railcar wheel.
Figure 7:
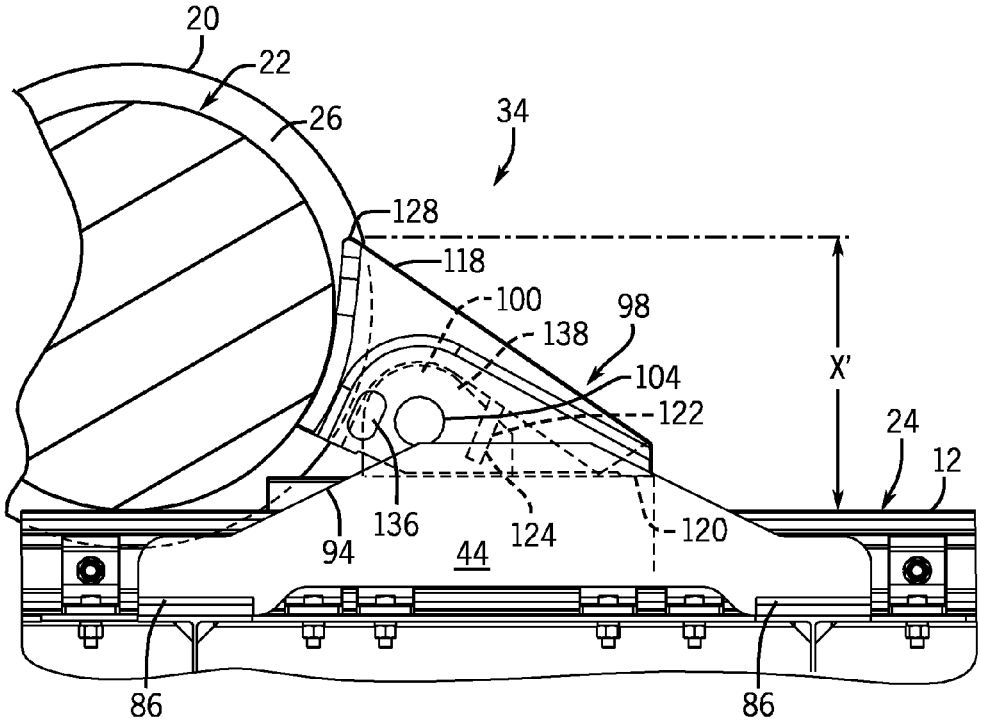
FIG. 7 is a side view of a railcar stop after initial engagement with the railcar wheel.

In operation, the railcar stops 32, 34 are configured to engage the wheel tread 22 to stop travel of the railcar along the rails 12. Each railcar stop 32, 34 extends above the rail 12 at a first height X (FIG. 6) prior to engagement with the wheel tread 22 and at a second, greater height X' (FIG. 7) after engagement with the wheel tread 22. In the example shown, each railcar stop 32, 34 is movable between a first position (FIG. 6) wherein the railcar stop 32, 34 extends above the rails 12 at the first height X and a second position (FIG. 7) wherein the railcar stop extends above the rail 12 at the second, greater height X'. Prior to engagement with the wheel tread 22, the railcar stop 32, 34 is biased into the first position (FIG. 6) by the spring 122, as discussed above. The top end 128 of the curved bearing surface 116 on the fin 98 is located at the height X and projects in the uptrack direction 16 and is configured to initially engage with the wheel tread 22 as the wheel 20 moves in the downtrack direction 18. Upon engagement, the wheel tread 22 forces the top end 128 of the curved bearing surface 116 of the fin 98 to move in the downtrack direction which results in a pivoting movement of the fin 98 about the pivot pin 106 and into the second position (FIG. 7). Therefore, the railcar stop 32, 34, and more specifically the fin 98 is pivotable from the first position (FIG. 6) to the second position (FIG. 7) upon engagement with the wheel 20. The top end 128 of the curved surface 116 is located at the first height X when the railcar stop 32, 34 is in the first position, and at the second greater height X' when the railcar stop 32, 34 is pivoted into the second position. Thus, the top end 128 of the fin 98 is positioned at a height that is lower in the first position, as compared to the height in the second position. The top end 128 is preferably situated at or above the centerline of a wheel bearing on wheel 20 at engagement with the wheel 20 to prevent the wheel 20 from rolling over the railcar stop 32, 34. The wheel tread 22 engages the top end 128 of the curved surface 116 at a location above the pivot pin 106, which results in a moment balance about the pivot pin 106, and which causes the fin 98 to pivot about the pivot axis 106 so that the top end 128 moves upwardly and in the downtrack direction 18 until the fin 98 is registered in the second position (FIG. 7), at which point the top end 128 is located at the second, greater height X'. The fin 98 includes a bottom surface 120 that includes an abutment surface for engaging with the base 96 of the wing 40, thus registering the fin 98 in the second position (FIG. 7).

Figure 8:
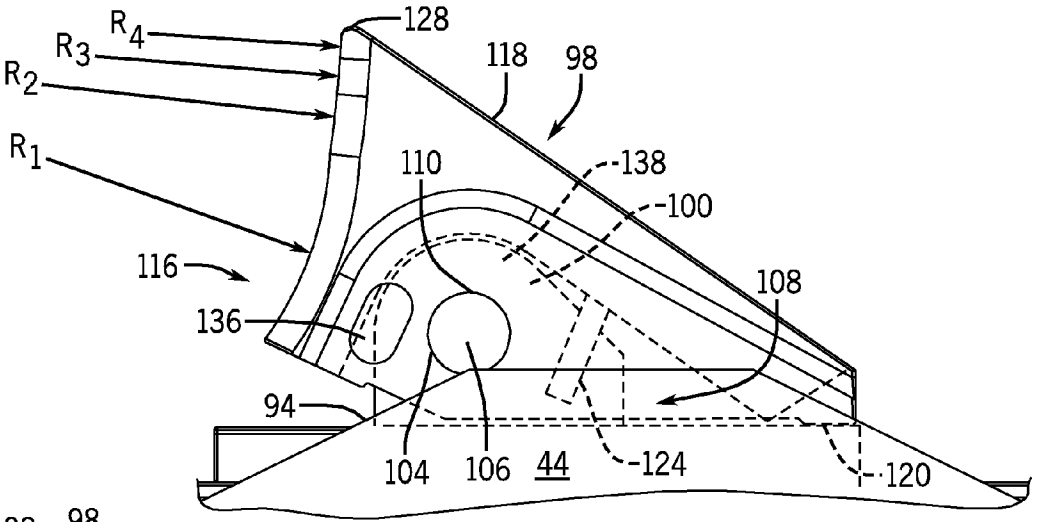
FIG. 8 is a partial side view of a railcar stop having a multi-segmented, curved surface.

Referring to FIG. 8, the curved surface 116 in the example shown can be multi-segmented. In other words, the curved surface 116 includes a plurality of different radiuses $r_1$-$r_4$. Each of the different radiuses $r_1$-$r_4$ are preferably designed to mate with railcar wheels of different sizes, so that each differently sized wheel will contact the curved surface 116 at a different location during pivoting and engagement.

Figure 3:
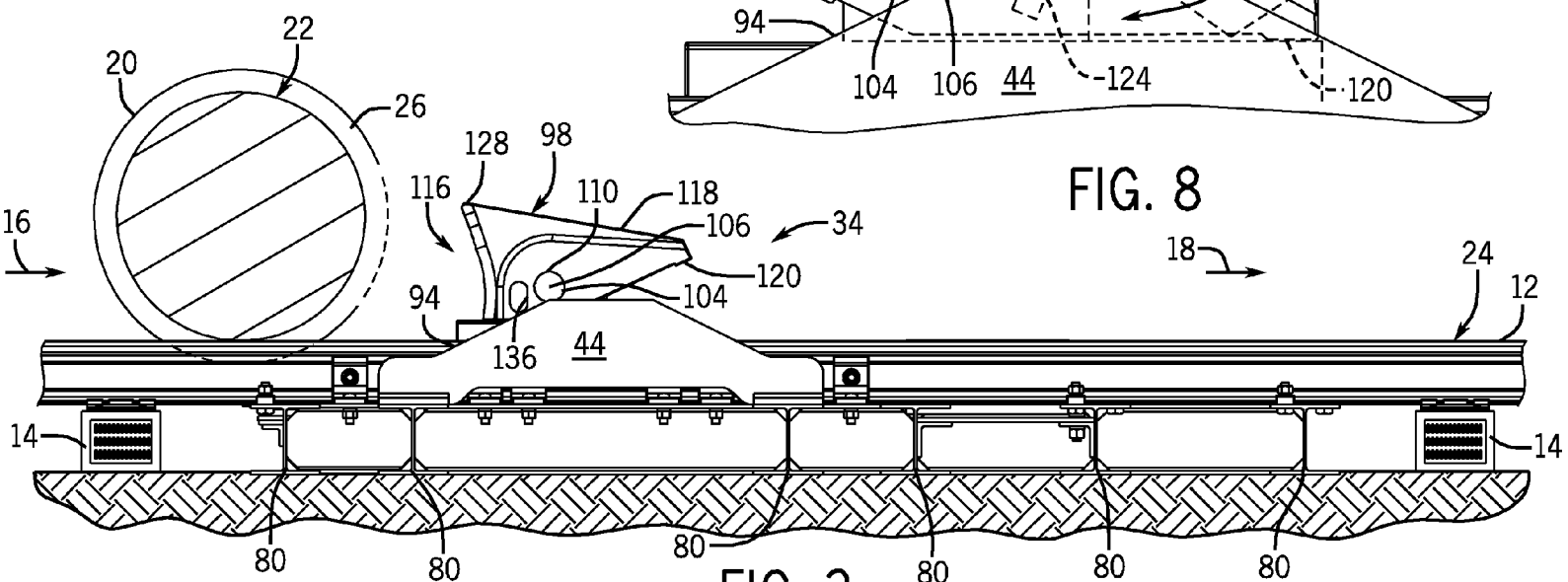
FIG. 3 is a side view of a railcar wheel traveling towards a railcar stop associated with the system shown in FIG. 2.

As best shown in FIGS. 1 and 3, the railcar stops 32, 34 can each have a lug 136 that extends outwardly from a side surface 138 of fin 98. The lug 136 is configured to engage with the upwardly sloped surface 94 of the backing member 44, but only if the fin 98 fails to pivot from the first position to the second position upon engagement with the railcar wheel 20. Such an event can occur if there is a wheel defect or malfunction in the railcar stop 32, 34 that prevents pivoting action of the fin 98. Failure of the fin 98 to pivot from the first position to the second position causes the force from the wheel 20 to transfer to the wing 40 and then to the shock absorber 46. Shock absorber 46 is configured to bias the railcar stop 32, 34 into the uptrack direction 16 against such a force from the wheel 20 as the wheel 20 engages with the railcar stop 32, 34. Additional mechanism for biasing the railcar stop 32, 34 can be employed, such as one or more springs, and/or the like. When the force from the wheel 20 overcomes the bias of the shock absorber 46, the wing 40 and fin 98 translate in the downtrack direction 18 towards the shock absorber 46. If the fin 98 fails to properly pivot into the second position, the lug 136 engages with upwardly sloped surface 94 of the backing member 44 and the fin 98 is forced into the second position as the lug 136 is forced upwardly along the sloped surface 94. This serves as a safety measure should the fin 98 fail to pivot. If the fin 98 properly pivots into the second position, the lug 136 is elevated above the top end 137 of the sloped surface 94 and engagement between the lug 136 and surface 94 is avoided.

The wing 40 also can include a derailer 140 for derailing the railcar should the railcar stop 32, 34 fail to impede travel of the railcar along the rails 12. The structure and function of the derailer 140 is described in applicant's co-pending U.S. application Ser. No. 12/427,810, incorporated herein by reference.

In a preferred example, the top end 128 of the fin 98 in the second position is 19 inches above the top surface 24 of the rail 12. That is, X' equals 19 inches. The top end 128 in the first position is 16 inches or less above the top surface 24 of the rail 12. This advantageously prevents unintended contact with low-hanging equipment on standard railcars, such as standard brake equipment.

Figure 9:
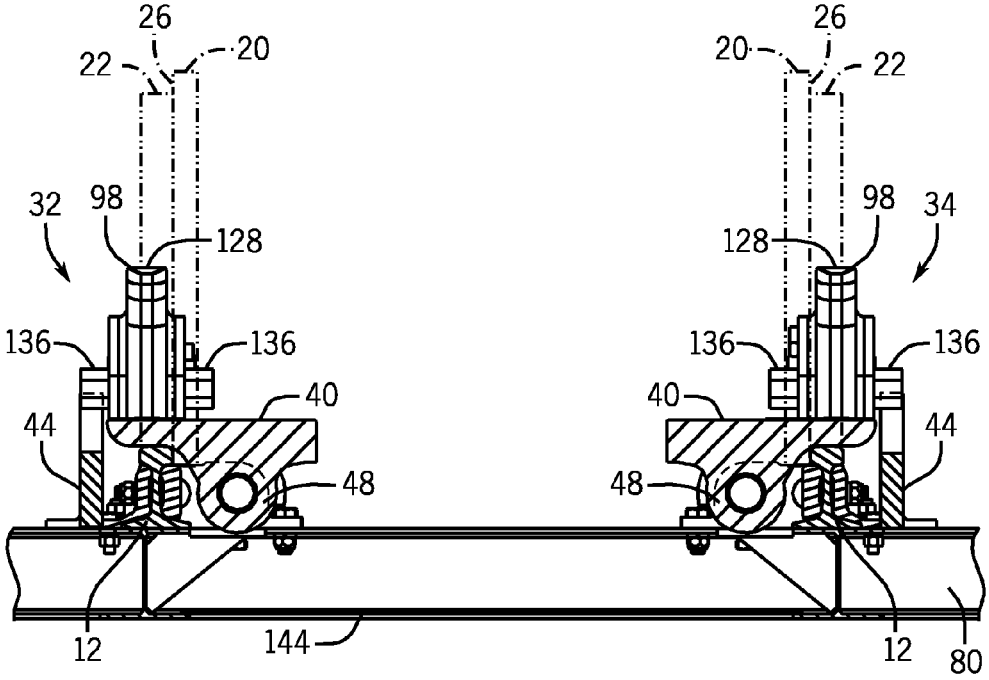
FIG. 9 is a sectional end view of adjacent railcar stops in active positions.
Figure 10:
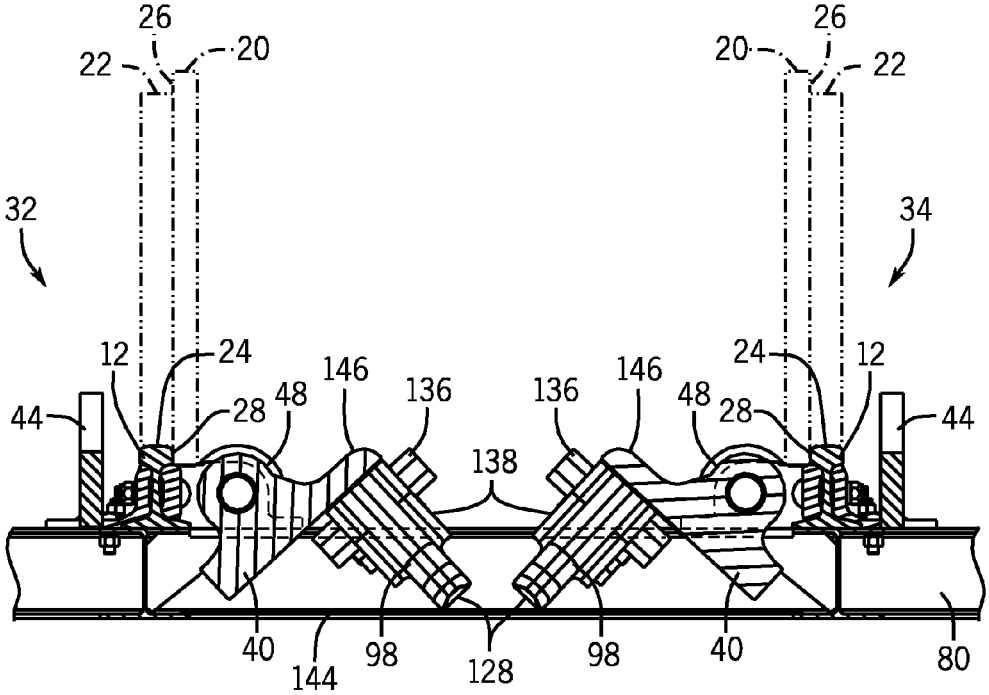
FIG. 10 is a sectional end view of adjacent railcar stops in inactive positions.

FIG. 9 shows the railcar stops 32, 34 in a raised, active position wherein the railcar stops 32, 34 are configured to engage the treads 22 on the railcar wheels 20, as disclosed herein above. FIG. 10 shows the railcar stops 32, 34 in a lowered, inactive position wherein a railcar is allowed to freely travel through the section of tracks 10 in the downtrack direction 18. In the lowered, inactive position, the wings 40 are rotated inwards towards each other about the longitudinal axis A. In the lowered position, the uppermost portion 146 of the wings 40 is positioned below the lowest clearance point on the underside of the railcar to allow for free passage of the railcar over the system 30 without engagement with low-hanging equipment on the railcar. Rotation from the inactive position (FIG. 10) to the active position (FIG. 9) is allowed until the bottom surface 146 of wing 40 engages with the top surface 24 of the rail 12. Rotation from the active position (FIG. 9) into the inactive position (FIG. 10) is allowed until engagement occurs between the top 128 of fin 98 and a base plate 144 located between and beneath the rails 12.

A control system in accordance with the disclosure provided in applicant's co-pending U.S. patent application Ser. No. 12/247,810 incorporated herein by reference can be provided for controlling movement of the wings between the active and inactive positions shown in FIGS. 9 and 10.

The system 30 described herein provides a railcar stop that is configured to move between a first position (FIG. 6) wherein the railcar stop engages with at least one wheel tread and extends above the rails at a first height, a second position (FIG. 7) wherein the railcar stop engages with the rail tread and extends above the rails at a second height, and a third position (FIG. 10) wherein the railcar stop does not engage with the wheel tread as the railcar passes by the railcar stop on the rails. A motor can be coupled to the railcar stop and configured to move the railcar stop from the first and second positions to the third position, and vice versa. A shock absorber is configured to bias the railcar stop in the uptrack direction against force from a wheel of the railcar as the wheel engages with the railcar stop. An additional one or more springs can be provided to ensure proper travel. The railcar stop is movable from the uptrack direction towards the downtrack direction as the shock absorber absorbs the force applied to the railcar stop by the wheel.

What is claimed is:

1. A device for stopping travel of a railcar that rides along a pair of rails, the railcar having a plurality of wheels, each wheel in the plurality of wheels having a wheel tread that rides along one of the pair of rails, the device comprising:

a wing having a base and having a fin that extends upwardly from the base, wherein the fin has a bottom surface that faces the base, the bottom surface having a front abutment surface and a rear abutment surface, and wherein the fin also has a bearing surface for engaging a wheel tread of a wheel in the plurality of wheels, the bearing surface transversely extending with respect to the bottom surface;

wherein the fin is pivotable with respect to the base between a first position in which the front abutment surface abuts the base and the rear abutment surface is spaced apart from the base and a second position in which the rear abutment surface abuts the base and the front abutment surface is spaced apart from the base;

wherein engagement of the wheel tread with an upper portion of the bearing surface causes the fin to pivot from the first position to the second position until the rear abutment surface engages with the base; and wherein the wing is pivotable about a longitudinal axis that extends parallel to one rail of the pair of rails, the wing being pivotable perpendicularly transversely with respect to the one rail between an active position wherein the fin is positioned over the one rail to engage the wheel tread and an inactive position wherein the fin is positioned away from the one rail so that the wheel can freely travel along the one rail past the wing.

2. The device according to claim 1, wherein in the first position the bearing surface is oriented with respect to the rail so that only the top portion of the bearing surface can engage with the wheel tread and in the second position the entire bearing surface can engage with the wheel tread.

3. The device according to claim 2, wherein the bearing surface is curved.

4. The device according to claim 3, wherein the bearing surface has a plurality of curved segments, each segment having a different radius of curvature for mating with wheels in the plurality of wheels that have different diameters, respectively.

5. The device according to claim 3, wherein the fin has a triangular-profile with a hypotenuse that extends downwardly from the top portion of the curved bearing surface towards the rear abutment surface of the base.

6. The device according to claim 1, wherein the wing is one of a pair of wings that are oppositely oriented with respect to each other for positioning between the rails and engaging respective wheels in the plurality of wheels that ride together along the rails, each wing in the pair respectively comprising the base and fin.

7. The device according to claim 1, comprising a connecting pin extending along the longitudinal axis, wherein rotation of the connecting pin causes pivoting of the wing between the active and inactive positions.

8. The device according to claim 1, comprising a spring biasing the fin into the first position.

9. The device according to claim 8, wherein the fin is pivotably attached to the base by a lobe and a pivot pin extending through the lobe.

10. The device according to claim 9, wherein the spring is disposed in the fin.

* * * * *